US012221310B2

(12) United States Patent
Nishimura

(10) Patent No.: US 12,221,310 B2
(45) Date of Patent: Feb. 11, 2025

(54) SHEET EJECTION DEVICE, SHEET POST-PROCESSING DEVICE INCLUDING THE SAME AND IMAGE FORMING SYSTEM

(71) Applicant: KYOCERA Document Solutions Inc., Osaka (JP)

(72) Inventor: Takuya Nishimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 139 days.

(21) Appl. No.: 18/327,588

(22) Filed: Jun. 1, 2023

(65) Prior Publication Data

US 2023/0399189 A1 Dec. 14, 2023

(30) Foreign Application Priority Data

Jun. 10, 2022 (JP) ..... 2022-094200

(51) Int. Cl.
*B65H 29/14* (2006.01)
*B65H 37/04* (2006.01)

(52) U.S. Cl.
CPC ..... *B65H 29/14* (2013.01); *B65H 37/04* (2013.01)

(58) Field of Classification Search
CPC ..... B65H 2404/68; B65H 29/14; B65H 2404/693; B65H 37/04; B65H 2402/30
See application file for complete search history.

(56) References Cited

U.S. PATENT DOCUMENTS 8,833,753 B2 * 9/2014 Araishi ..... G03G 15/607 271/265.01
2014/0008862 A1 * 1/2014 Lo ..... B65H 29/52 271/84
2017/0057773 A1 * 3/2017 Nakano ..... B65H 31/26

FOREIGN PATENT DOCUMENTS

JP 2005-263475 A 9/2005

* cited by examiner

*Primary Examiner* — Jennifer Bahls
(74) *Attorney, Agent, or Firm* — Stein IP, LLC

(57) ABSTRACT

A sheet ejection device includes an ejection roller pair, a stacking tray, a protrusion member and a movement mechanism. The protrusion member is supported to be able to reciprocate between a protrusion position and a retraction position in a predetermined movement direction. The movement mechanism includes: a rotation shaft; a holding member; and a rack and pinion mechanism which includes a pinion gear and a rack gear. In at least a part of the rack gear in the movement direction, a narrow width region is provided which includes a narrow width gear and a cutout portion. In the narrow width region, the pinion gear is slidable between a meshing position and a release position, and in a state where the pinion gear has slid to the release position, the protrusion member can be relatively moved with respect to the pinion gear in the movement direction.

7 Claims, 8 Drawing Sheets

SHEET EJECTION DEVICE, SHEET POST-PROCESSING DEVICE INCLUDING THE SAME AND IMAGE FORMING SYSTEM

INCORPORATION BY REFERENCE

This application is based upon and claims the benefit of priority from the corresponding Japanese Patent Application No. 2022-094200 filed on Jun. 10, 2022, the entire contents of which are incorporated herein by reference.

BACKGROUND

The present disclosure relates to a sheet ejection device, a sheet post-processing device including it and an image forming system.

Conventionally, an image forming system is provided which includes an image forming apparatus (such as a copying machine or a printer) and a sheet post-processing device arranged on the downstream side of the image forming apparatus. The sheet post-processing device can perform predetermined post-processing such as binding processing and punch hole forming processing. The binding processing is post-processing in which a plurality of sheets (recording media such as print sheets and envelopes) having images formed by the image forming apparatus are stacked as a bundle, and the bundle of sheets are bound together with staples. The punch hole forming processing is post-processing in which a punch hole forming device is used to punch holes (perforations) in a sheet or a bundle of sheets.

In the sheet post-processing device as described above, a sheet ejection device is installed. The sheet ejection device as described above includes an ejection roller pair, a stacking tray, a plurality of protrusion members and a movement mechanism. The ejection roller pair ejects a sheet on which post-processing has been performed. On the stacking tray, sheets ejected by the ejection roller pair are stacked.

The protrusion members are aligned linearly along the axial direction of the ejection roller pair. The protrusion members are provided above the stacking tray. The protrusion members are supported to be able to reciprocate between a protrusion position and a retraction position. The protrusion position is a position in which the sheet ejected by the ejection roller pair is brought into contact with the upper surface of the protrusion member. The retraction position is a position in which the protrusion member is retracted from the contact position to the upstream side of the ejection roller pair.

The movement mechanism reciprocates the protrusion member between a movement position and the retraction position. The movement mechanism as described above includes a rotation shaft and a plurality of gears. The rotation shaft extends parallel to the center axis of the ejection roller pair. The gears include a pinion gear which is supported by the rotation shaft and a rack gear which is formed in the protrusion member. The pinion gear and the rack gear are engaged. The rotation shaft is rotated, and thus the protrusion member is moved via the pinion gear and the rack gear.

The sheets ejected by the ejection roller pair are temporarily stacked on the protrusion members in the protrusion positions, and are thereafter stacked on the stacking tray. The sheets are temporarily stacked on the protrusion members, and thus while the drooping of end portions of the sheets on the downstream side in a sheet ejection direction is being suppressed, the sheets can be stacked on the stacking tray. The sheet ejection device as described above can also be installed around the ejection port of the image forming apparatus or the like through which the sheet is ejected.

SUMMARY

In order to achieve the object described above, a sheet ejection device according to one aspect of the present disclosure and having a first configuration of the present disclosure includes an ejection roller pair, a stacking tray, a protrusion member and a movement mechanism. The ejection roller pair ejects a sheet from an ejection port in a predetermined ejection direction. The stacking tray is arranged on a downstream side of the ejection roller pair in the ejection direction, and the sheet ejected by the ejection roller pair is stacked thereon. The protrusion member protrudes above the stacking tray from the ejection port and is supported to be able to reciprocate between a protrusion position where a tip end of the sheet ejected by the ejection roller pair is brought into contact with an upper surface to be guided in the ejection direction and a retraction position where the protrusion member is retracted from above the stacking tray. The movement mechanism moves the protrusion member in a predetermined movement direction between the protrusion position and the retraction position. The movement mechanism includes: a rotation shaft which extends in a width direction orthogonal to the ejection direction and is rotatably supported; a holding member which is coupled to the rotation shaft and holds the protrusion member movably along the movement direction; and a rack and pinion mechanism which includes: a pinion gear supported by the rotation shaft; and a rack gear including a large number of gear teeth which are formed on a surface of the protrusion member opposite the pinion gear and are aligned along the movement direction of the protrusion member. In at least a part of the rack gear in the movement direction, a narrow width region is provided which is formed by cutting out a part of the gear teeth in the axial direction and which includes a narrow width gear and a cutout portion. In the narrow width region, the pinion gear is slidable between a meshing position where the pinion gear meshes with the narrow width gear and a release position where the pinion gear is opposite the cutout portion such that the meshing with the narrow width gear is released. In a state where the pinion gear has slid to the release position, the protrusion member can be relatively moved with respect to the pinion gear in the movement direction.

DETAILED DESCRIPTION

Figure 1:
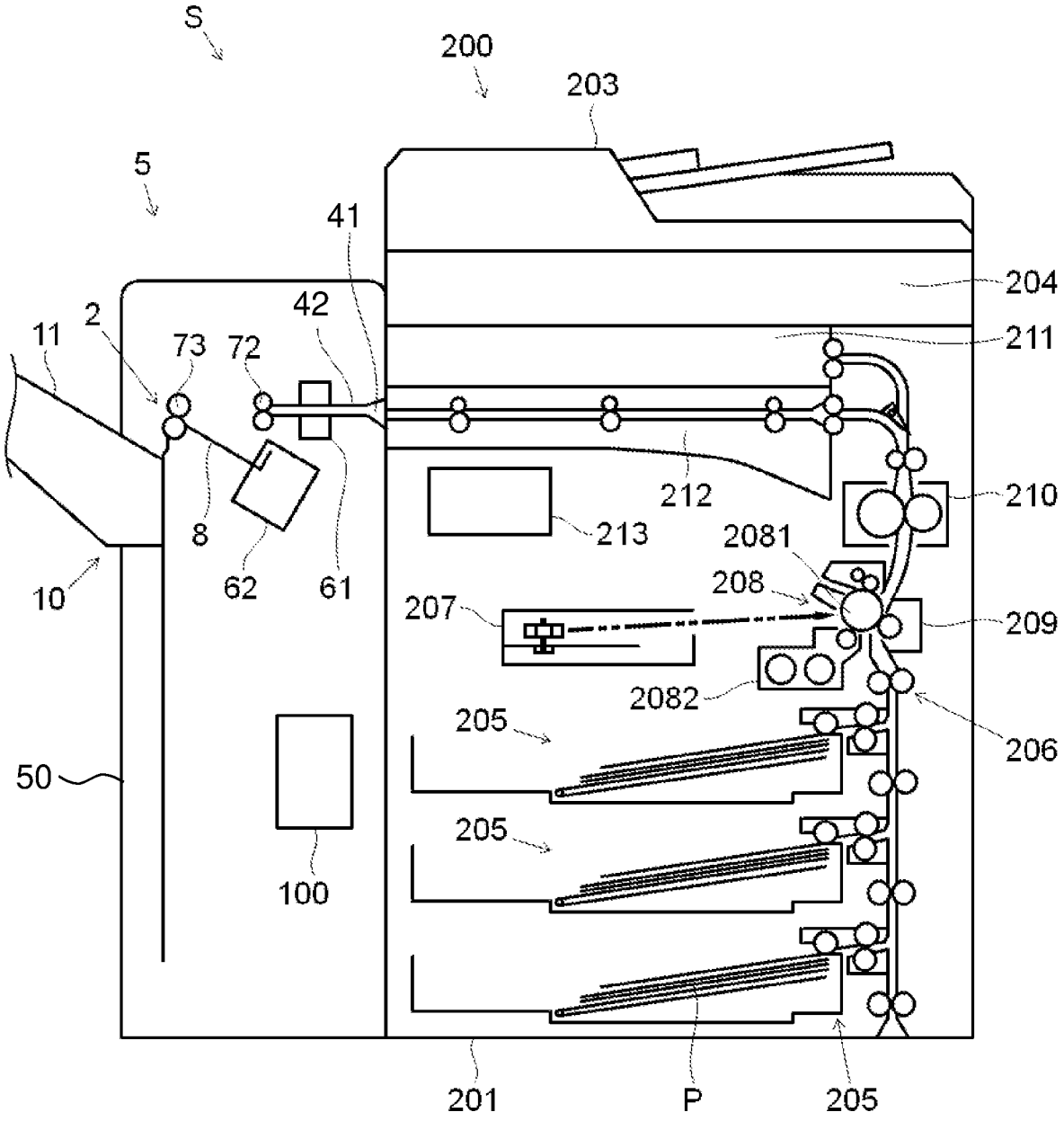
FIG. 1 is a schematic view of an image forming system S including an image forming apparatus and a sheet post-processing device according to an embodiment of the present disclosure.

An embodiment of the present disclosure will be described below with reference to drawings FIG. 1 is a schematic view of an image forming system S including an image forming apparatus 200 and a sheet post-processing device 5 according to the embodiment of the present disclosure. The image forming system S includes the image forming apparatus 200 and the sheet post-processing device 5.

The image forming apparatus 200 is, for example, a so-called multifunctional peripheral for monochrome which has the functions of print (printing), scanning (image reading), facsimile transmission and the like. In the image forming apparatus 200, as shown in FIG. 1, an auto document feeder 203 is placed on the upper surface of a main body 201. An image reading unit 204 is provided below the auto document feeder 203 within the main body 201. An image in a document stacked on the auto document feeder 203 or an image in a document placed on unillustrated contact glass of the upper surface of the image reading unit 204 is read by the image reading unit 204.

The image forming apparatus 200 further includes a sheet feed unit 205, a sheet conveying unit 206, an exposure unit 207, an image formation unit 208, a transfer unit 209, a fixing unit 210, a sheet ejection unit 211, a relay unit 212 and a main body control unit 213.

The sheet feed unit 205 stores a plurality of sheets P, and separates and feeds sheets P one by one at the time of printing. The sheet conveying unit 206 conveys the sheet P fed from the sheet feed unit 205 to the transfer unit 209 and the fixing unit 210, and further distributes the sheet P after fixing either to the sheet ejection unit 211 or to the relay unit 212. The exposure unit 207 applies laser light controlled based on image data toward the image formation unit 208.

The image formation unit 208 includes a photosensitive drum 2081 which is an image carrying member and a development device 2082. In the image formation unit 208, an electrostatic latent image for the document image is formed on the surface of the photosensitive drum 2081 by the laser light applied from the exposure unit 207. The development device 2082 supplies a toner to the electrostatic latent image and develops the electrostatic latent image to form a toner image. The transfer unit 209 transfers, to the sheet P, the toner image on the surface of the photosensitive drum 2081 formed by the image formation unit 208. The fixing unit 210 heats and pressurizes the sheet P to which the toner image has been transferred to fix the toner image on the sheet P.

The sheet P after fixing is fed to the sheet ejection unit 211 or the relay unit 212. The sheet ejection unit 211 is arranged below the image reading unit 204. The sheet ejection unit 211 includes an opening in a front surface, and the sheet (printed product) after printing is removed from the side of the front surface. The relay unit 212 is arranged below the sheet ejection unit 211. A downstream end of the relay unit 212 in a sheet conveying direction is coupled to the sheet post-processing device 5. The sheet (printed product) after printing which is fed to the relay unit 212 is passed through the interior of the relay unit 212, and is conveyed to the sheet post-processing device 5.

The main body control unit 213 includes a CPU, an image processing unit and a storage unit which are not shown in the figure, and an electronic circuit and electronic components which are not shown in the figure. The CPU controls, based on control programs and data stored in the storage unit, the operations of constituent elements provided in the image forming apparatus 200, and performs processing related to the functions of the image forming apparatus 200. The sheet feed unit 205, the sheet conveying unit 206, the exposure unit 207, the image formation unit 208, the transfer unit 209 and the fixing unit 210 each receive individual instructions from the main body control unit 213, and perform printing on the sheet P in a cooperative manner. The storage unit is formed, for example, by a combination of nonvolatile storage devices such as a program ROM (Read Only Memory) and a data ROM which are not shown in the figure and a volatile storage device such as a RAM (Random Access Memory).

The sheet post-processing device 5 is detachably coupled to the side surface of the image forming apparatus 200. The sheet post-processing device 5 includes a post-processing housing 50 and a sheet conveying path 42, a processing tray 8, a perforation processing unit 61, a staple processing unit 62, a conveying roller pair 71, an intermediate roller pair 72, a first sheet detection unit S1, an ejection roller pair 73, a second sheet detection unit S2, a sheet ejection device 10 and a post-processing control unit 100 which are arranged within the post-processing housing 50.

On the side surface of the post-processing housing 50 opposite the image forming apparatus 200, a sheet carry-in port 41 is provided. The sheet P which has been passed through the relay unit 212 is passed through the sheet carry-in port 41 and is carried into the sheet post-processing device 5.

The sheet conveying path 42 extends from the sheet carry-in port 41 to above the processing tray 8 in a direction (left direction in FIG. 1) away from the image forming apparatus 200. In the processing tray 8, the sheet P can be temporarily stacked on the upper surface thereof. The sheet P carried in from the sheet carry-in port 41 is stacked on the upper surface of the processing tray 8 by the sheet conveying path 42.

The processing tray 8 is inclined downward from a downstream side end portion toward an upstream side end portion in the sheet conveying direction. The processing tray 8 includes a bundle ejection member 81. The bundle ejection member 81 is provided at the upstream side end portion of the processing tray 8 in the sheet conveying direction.

The bundle ejection member 81 supports the upstream side end portion (back end) of the bundle of sheets. The bundle ejection member 81 is fixed to a drive belt (not shown) arranged on the side of the back surface of the processing tray 8, and a part thereof protrudes from the placement surface of the processing tray 8 in the shape of a letter "L" in side view. The drive belt is turned by the post-processing control unit 100, and thus the bundle ejection member 81 reciprocates along the placement surface of the processing tray 8 in the sheet conveying direction.

The perforation processing unit 61 is arranged between the sheet carry-in port 41 and the downstream end of the sheet conveying path 42 in the sheet conveying direction. The perforation processing unit 61 performs perforation processing on the sheet P conveyed along the sheet conveying path 42. The perforation processing is processing for forming punch holes (binding holes). Here, the punch holes are formed along a side edge on one side in the width direction of the sheet orthogonal to the sheet conveying direction.

The staple processing unit 62 is arranged below the sheet conveying path 42 on the upstream side of the processing tray 8 in the sheet conveying direction. The staple processing unit 62 performs staple processing (binding processing) on the bundle of sheets P stacked on the processing tray 8. The staple processing is processing for binding the bundle of sheets P with staples. Here, so-called end binding processing for binding a corner or an end portion of the bundle of sheets with staples is performed.

Figure 2:
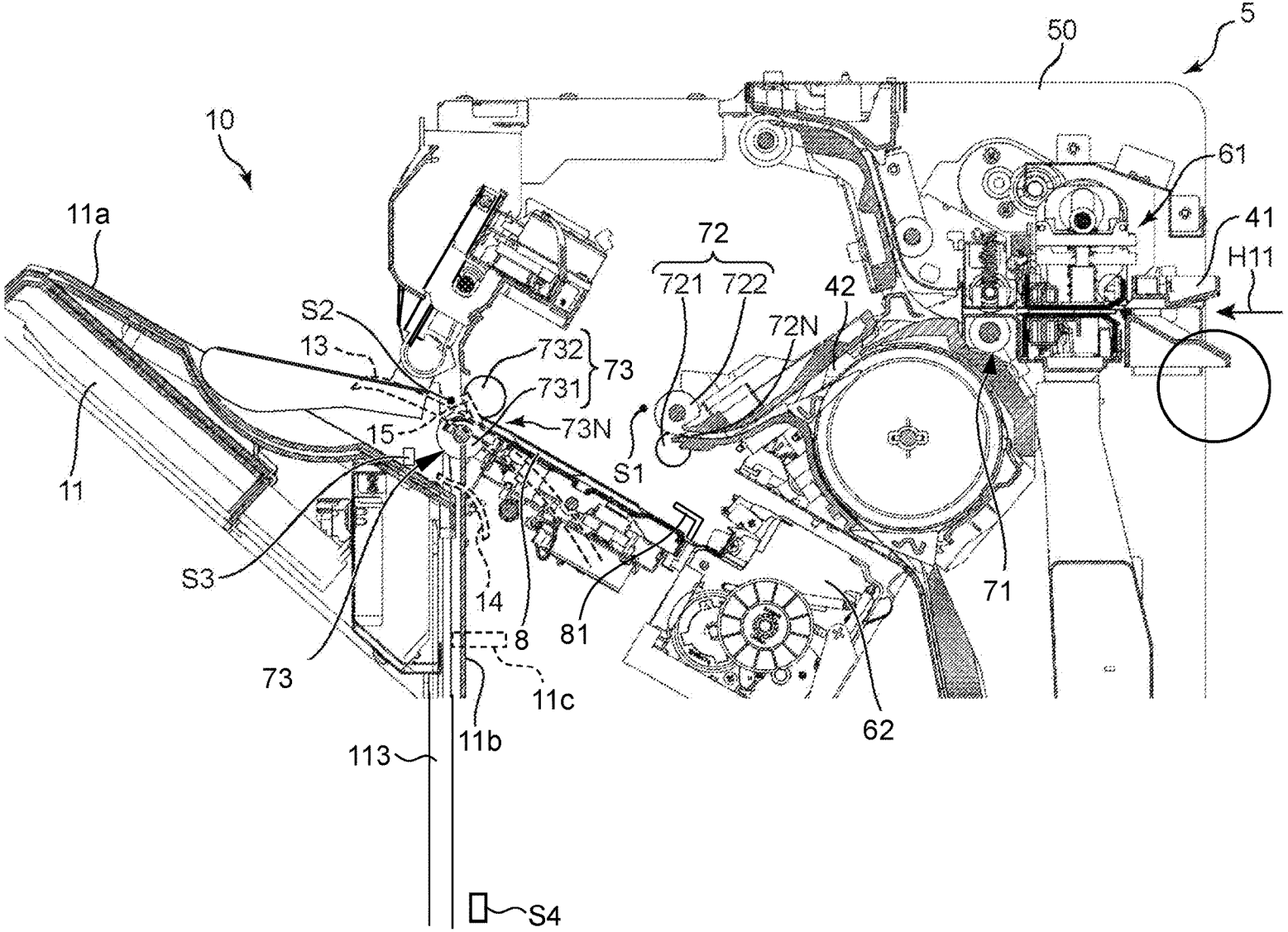
FIG. 2 is a side cross-sectional view showing an internal structure of the sheet post-processing device.
Figure 3:
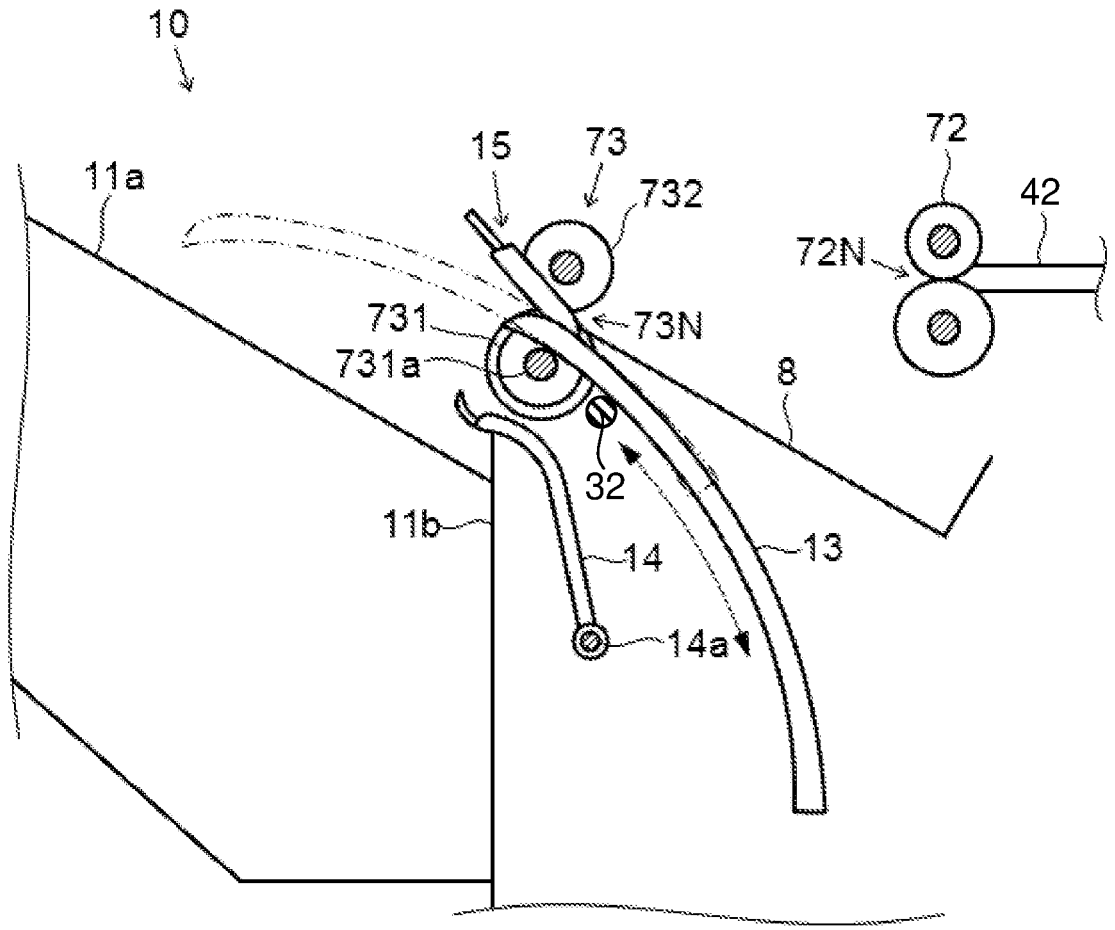
FIG. 3 is a partial cross-sectional view showing a structure around a processing tray in FIG. 2.

FIG. 2 is a side cross-sectional view showing an internal structure of the sheet post-processing device 5. FIG. 3 is a partial cross-sectional view showing a structure around the processing tray 8 in FIG. 2. As shown in FIGS. 2 and 3, the conveying roller pair 71, the intermediate roller pair 72 and the ejection roller pair 73 are aligned in this order from the upstream side in the sheet conveying direction.

The conveying roller pair 71 is adjacent to the downstream side of the perforation processing unit 61 in the sheet conveying direction. The conveying roller pair 71 conveys the sheet after the perforation processing or the sheet on which the perforation processing is not performed to the downstream side in the sheet conveying direction (direction indicated by an arrow H11 in FIG. 2).

The intermediate roller pair 72 is arranged at the downstream side end portion of the sheet conveying path 42 in the sheet conveying direction. The intermediate roller pair 72 is located above the upstream side end portion (right end portion in FIG. 2) of the processing tray 8. The intermediate roller pair 72 ejects, onto the processing tray 8, the sheet P carried from the sheet carry-in port 41 into the sheet conveying path 42.

The intermediate roller pair 72 includes a first drive roller 721 and a first driven roller 722. The first drive roller 721 is connected to a drive source such as a motor (not shown), and the rotation thereof is controlled by the post-processing control unit 100. The first driven roller 722 forms a first nip portion 72N at which the first driven roller 722 presses the first drive roller 721 with a predetermined nip pressure to nip and convey the sheet. The first driven roller 722 is driven by the first drive roller 721 to rotate.

The first sheet detection unit S1 is arranged immediately on the downstream side of the intermediate roller pair 72 in a sheet ejection direction. The first sheet detection unit S1 is a sensor for optically detecting the sheet, and detects that a tip end of the sheet conveyed by the conveying roller pair 71 enters the intermediate roller pair 72. The first sheet detection unit S1 also detects that the sheet conveyed by the intermediate roller pair 72 has passed through the intermediate roller pair 72.

The ejection roller pair 73 is arranged on the downstream side of the intermediate roller pair 72 in the sheet ejection direction. The ejection roller pair 73 overlaps the downstream side end portion of the processing tray 8 in the sheet ejection direction.

The ejection roller pair 73 includes a second drive roller 731 (ejection roller) and a second driven roller 732 which presses the second drive roller 731 with a predetermined nip pressure. The second drive roller 731 and the second driven roller 732 form a second nip portion 73N which nips and conveys the sheet P. The second nip portion 73N is released by a nip release mechanism (not shown) when the staple processing is performed by the staple processing unit 62. The sheet P is stacked on the processing tray 8 in a state where the second nip portion 73N is released. The bundle of sheets on which the staple processing has been performed is ejected to the sheet ejection device 10 with the ejection roller pair 73 of the restored second nip portion 73N or the bundle ejection member 81.

The second drive roller 731 is supported by a drive roller shaft 731*a* to rotate together with the drive roller shaft 731*a*. A drive source such as a motor (not shown) is connected to the drive roller shaft 731*a*, and the rotation thereof is controlled by the post-processing control unit 100. When the drive roller shaft 731*a* is rotated, the second drive roller 731 is simultaneously rotated together with the drive roller shaft 731*a*.

The second sheet detection unit S2 is arranged immediately on the downstream side of the ejection roller pair 73. The second sheet detection unit S2 includes an actuator and a photosensor (both of which are not shown), and can detect whether or not the sheet is being ejected and whether or not the back end of the sheet has passed through the ejection roller pair 73.

The sheet ejection device 10 includes a sheet receiving wall 11*b*, a stacking tray 11, an upper surface detection sensor S3, a lower limit detection sensor S4 and a tray lifting/lowering drive unit 113. Although the sheet ejection device 10 includes, in addition to the configuration described above, protrusion members 13, sheet pressing members 14, paddle members 15, support holders 20 (holding members) and a movement mechanism 26, the details of the configurations thereof will be described later.

The sheet receiving wall 11*b* forms the side surface of the post-processing housing 50 on a side opposite to the image forming apparatus 200. The stacking tray 11 is arranged on the downstream side of the ejection roller pair 73 in the sheet ejection direction. The stacking tray 11 is supported to be able to be lifted and lowered with respect to the sheet receiving wall 11*b* via the tray lifting/lowering drive unit 113. On the upper surface of the stacking tray 11, a sheet stacking surface 11*a* is formed. The sheet stacking surface 11*a* is inclined such that the sheet stacking surface 11*a* extends upward as the sheet stacking surface 11*a* extends away from the sheet receiving wall 11*b*. The end portion of the sheet stacking surface 11*a* on the upstream side in the sheet ejection direction is located below the ejection roller pair 73.

The stacking tray 11 is a final sheet ejection location in the sheet post-processing device 5. The bundle of sheets on which the staple processing has been performed in the processing tray 8 is ejected toward the stacking tray 11 by the ejection roller pair 73 and is stacked on the sheet stacking surface 11*a*. When the staple processing is not performed by the staple processing unit 62, the sheet P is conveyed to the stacking tray 11 without being stacked on the processing tray 8. The sheet receiving wall 11*b* receives the upstream side end portion (back end) of the sheet which slides down along the sheet stacking surface 11*a*.

The upper surface detection sensor S3 is provided slightly on the downstream side of the upstream side end portion of the stacking tray 11 in the sheet ejection direction. The upper surface detection sensor S3 is a photosensor which detects the upper surface of the sheet P stacked on the sheet stacking surface 11*a*.

The lower limit detection sensor S4 is arranged lower than the lower limit position of the stacking tray 11 in the post-processing housing 50. The lower limit detection sensor S4 is the same photosensor as the upper surface detection sensor S3, and can detect that when the optical path of the detection unit is blocked by a flag 11*c* which is provided on the stacking tray 11 to protrude, the stacking tray 11 is lowered to the lower limit position.

The tray lifting/lowering drive unit 113 is coupled via a rail and a guide to the stacking tray 11 (not shown), and performs a lifting/lowering operation (positioning) on the stacking tray 11 based on the results of detection performed by the upper surface detection sensor S3 and the lower limit detection sensor S4 with a drive source such as a motor (not shown) according to a sheet stacking amount on the sheet stacking surface 11*a*. The lifting/lowering operation on the stacking tray 11 is performed every predetermined number of sheets (for example, 10 sheets) or at predetermined time intervals (for example, intervals of several seconds). In this way, the positions of the uppermost surfaces of the sheets on the sheet stacking surface 11*a* are maintained at a constant height.

The post-processing control unit 100 includes a CPU and the like which are not shown in the figure and an electronic circuit and electronic components which are not shown in the figure. The post-processing control unit 100 is connected to the main body control unit 213 to be able to communicate therewith. The post-processing control unit 100 receives instructions from the main body control unit 213, uses the CPU to control, based on the control programs and data stored in the storage unit, the operations of the constituent elements (the perforation processing unit 61, the staple processing unit 62, the conveying roller pair 71, the intermediate roller pair 72, the ejection roller pair 73, the processing tray 8, the sheet ejection device 10 and the like) provided in the sheet post-processing device 5 and performs processing related to the functions of the sheet post-processing device 5.

As shown in FIG. 3, the sheet pressing member 14 is arranged on the upstream side of the stacking tray 11 in the sheet ejection direction. The sheet pressing member 14 is arranged lower than the drive roller shaft 731*a*. Two sheet pressing members 14 are arranged at a predetermined interval in the sheet width direction of the stacking tray 11.

The sheet pressing member 14 is swingably supported at a lower end portion with a swinging shaft 14*a* extending along the sheet width direction being as a fulcrum. The sheet pressing member 14 swings around the swinging shaft 14*a* in the sheet ejection direction with one end portion on an upper side being a free end. The sheet pressing member 14 swings between a position in which the upstream portion of the sheet stacked on the stacking tray 11 in the sheet ejection direction is pressed from above and a position in which the pressing of the sheet is released. The swinging of the sheet pressing member 14 is controlled by the post-processing control unit 100.

The sheet pressing member 14 presses the back end of the sheet P stacked on the sheet stacking surface 11*a* from above. In this way, even if the sheet to be ejected is curled, the sheet pressing member 14 presses the back end of the sheet to be able to straighten the curl.

A plurality of (here, four) paddle members 15 are provided coaxially with the drive roller shaft 731*a*. The paddle members 15 are rotated independently of the drive roller shaft 731*a*. The four paddle members 15 are connected to a drive source such as a motor (not shown), and the rotation thereof is controlled by the post-processing control unit 100.

As shown in FIG. 3, before the start of a sheet ejection operation, the sheet pressing member 14 is stopped in such a position as not to protrude to the side of the stacking tray 11 so that the ejection of the sheet P is not prevented. Before the start of the sheet operation, the paddle member 15 is on standby in such a position as not to protrude either to the side of the processing tray 8 or to the side of the stacking tray 11 so that the ejection of the sheet P is not prevented.

The post-processing control unit 100 starts the rotation of the paddle members 15 before the sheet P is stacked on the sheet stacking surface 11*a* after the back end of the sheet P (upstream side end portion in the sheet ejection direction) has passed through the second nip portion 73N. Then, the paddle members 15 make contact with the back end of the sheet P ejected from the ejection roller pair 73 and press down the sheet P toward the sheet stacking surface 11*a* so as to hit the vicinity of the back end of the sheet P from above.

When the paddle members 15 are further rotated in this state, the paddle members 15 press the vicinity of the back end of the sheet P toward the sheet receiving wall 11*b* of the stacking tray 11 while pulling the sheet P along the stacking tray 11 to the upstream side in the ejection direction of the sheet P.

Before the paddle members 15 pass through the upstream end of the stacking tray 11 in the sheet ejection direction after the rotation of the paddle members 15 has been started, the swinging of the sheet pressing member 14 is started. Then, the sheet pressing member 14 is moved to a pressing position in which the upstream portion of the sheet stacked on the stacking tray 11 in the ejection direction is pressed from above.

Then, when a sheet stacking operation performed by the sheet post-processing device 5 is completed, the upstream end of the sheet P in the ejection direction makes contact with the sheet receiving wall 11*b* provided on the upstream side of the stacking tray 11 in the sheet ejection direction. In this way, the sheets P are aligned in a predetermined position on the stacking tray 11.

Figure 4:
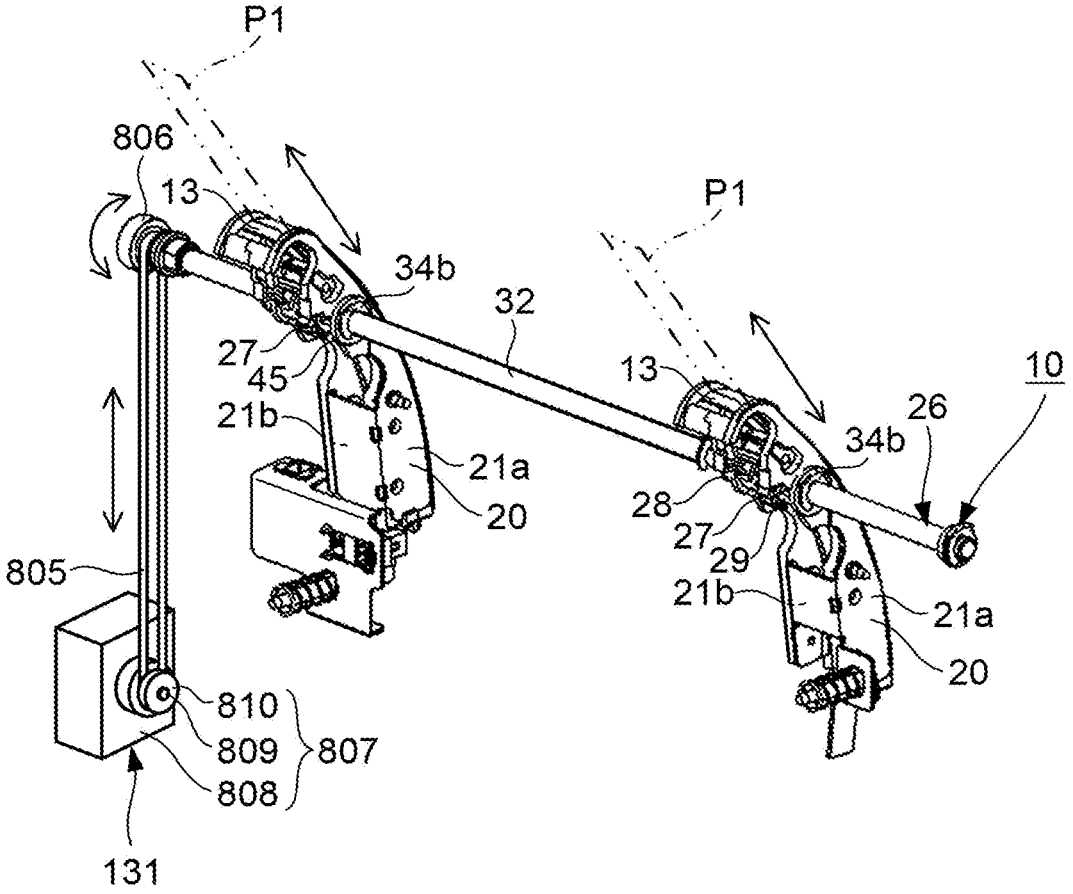
FIG. 4 is a perspective view showing a structure around protrusion members in a sheet ejection device.

FIG. 4 is a perspective view showing a structure around the protrusion members 13 in the sheet ejection device 10. As shown in FIGS. 3 and 4, the protrusion members 13 are bar-shaped members each of which extends in the shape of an arc along the sheet ejection direction. The protrusion members 13 are arranged below a sheet ejection port 2. Specifically, the protrusion members 13 are arranged below the processing tray 8 and below the ejection path of the sheet ejected from the ejection roller pair 73 along the processing tray 8. A plurality of (here, two) protrusion members 13 are arranged at a predetermined interval with a center portion of the stacking tray 11 in the sheet width direction being located between the protrusion members 13. The protrusion members 13 and the paddle members 15 are aligned in the sheet width direction.

The support holders 20 are fixed to the post-processing housing 50 (not shown). As shown in FIG. 4, the support holders 20 are respectively provided in such positions as to overlap the protrusion members 13 in the sheet width direction.

Figure 5:
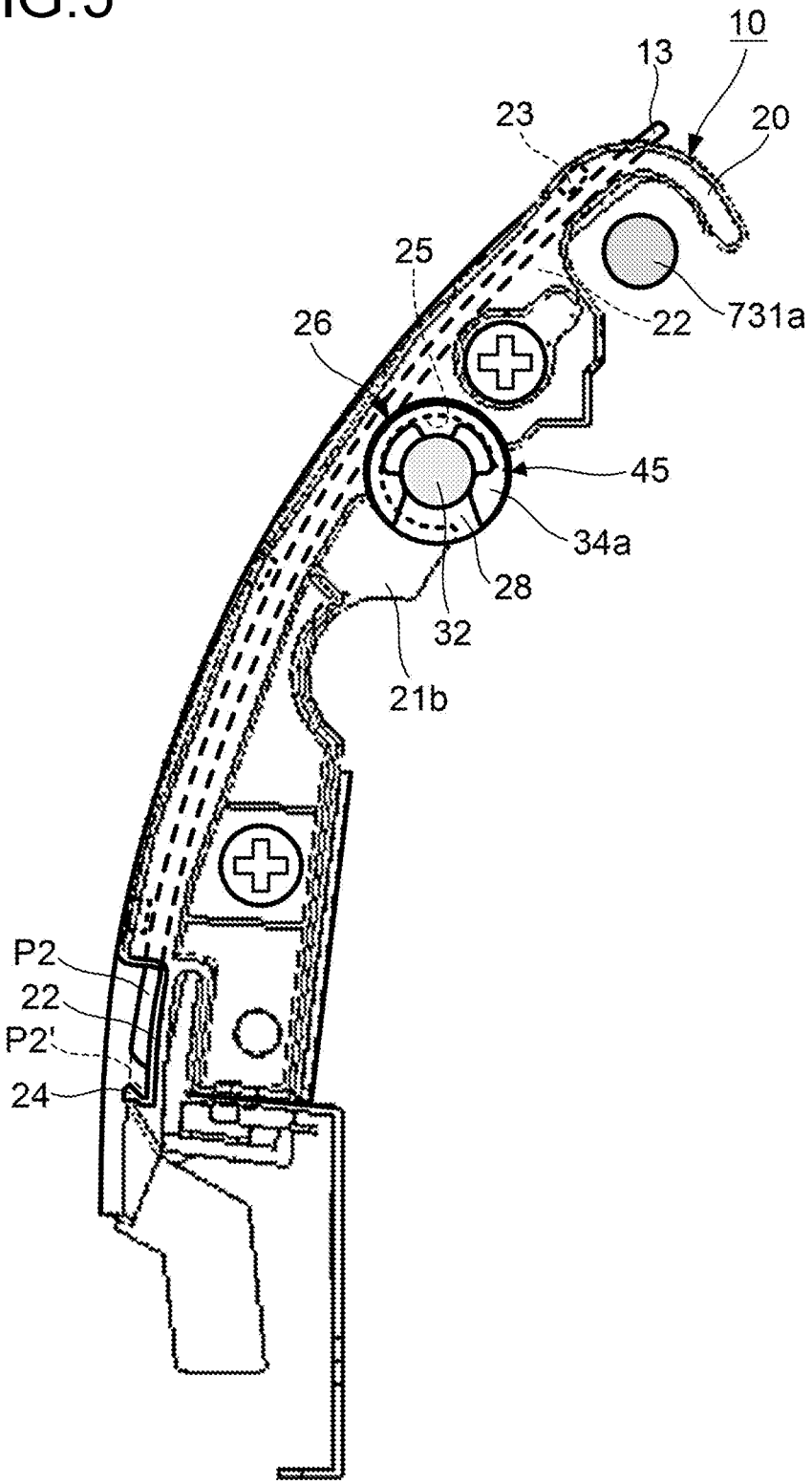
FIG. 5 is a side view of a support holder when the side surface of the support holder is viewed in an axial direction.
Figure 6:
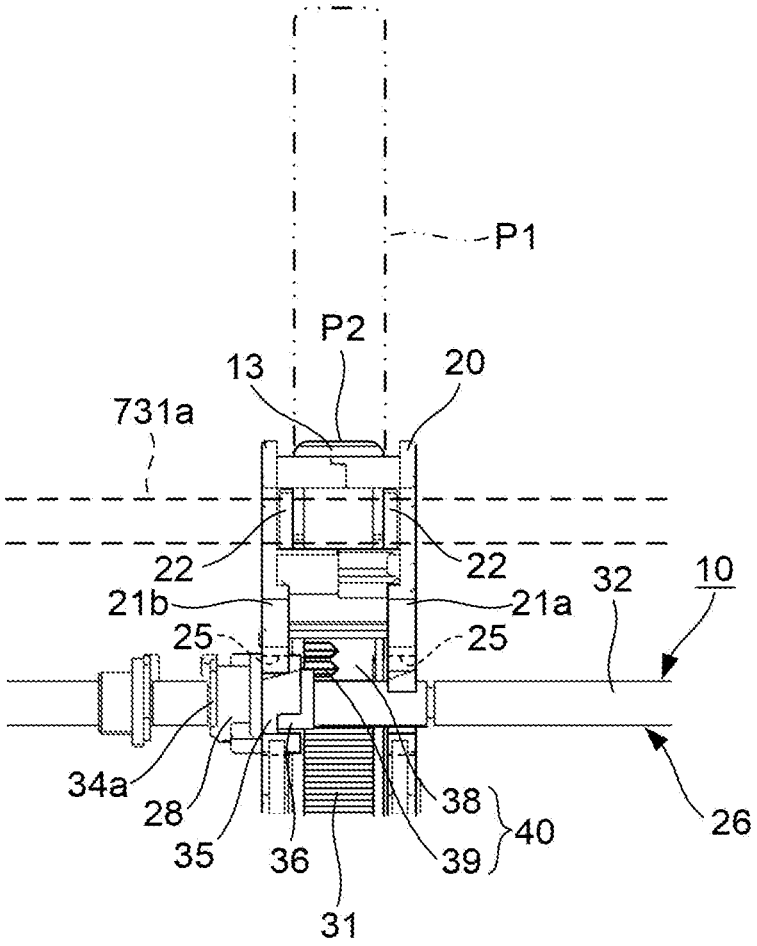
FIG. 6 is a side view of the sheet ejection device when a structure in the vicinity of the protrusion member is viewed from a downstream side in a sheet ejection direction.

FIG. 5 is a side view of the support holder 20 when the side surface of the support holder 20 is viewed in an axial direction (direction along a rotation shaft 32 which will be described later). FIG. 6 is a side view of the sheet ejection device 10 when a structure in the vicinity of the protrusion member 13 is viewed from the downstream side (lower left side of FIG. 4) in the sheet ejection direction. In FIG. 6, a first set collar 28 and a pinion gear 27 are omitted. As shown in FIGS. 4 to 6, the support holder 20 includes side wall portions 21*a* and 21*b*, a guide rail 22, a cover rib 23 and a locating protrusion portion 24.

The side wall portions 21*a* and 21*b* are plate-shaped parts which are formed at both ends of the support holder 20 in the axial direction. The side wall portions 21*a* and 21*b* are opposite each other in the axial direction. In the side wall portions 21*a* and 21*b*, collar support holes 25 which penetrate in the axial direction are formed. The protrusion member 13 is arranged between the side wall portions 21*a* and 21*b* in the axial direction.

The guide rail 22 is in the shape of ribs which protrude from the side wall portions 21*a* and 21*b* toward the inside of the support holder 20 in the axial direction. The guide rail 22 extends parallel to the movement direction of the protrusion member 13 along the shape of the arc in the protrusion member 13. The cover rib 23 is provided opposite the guide rail 22 in a direction orthogonal to the axial direction and the sheet ejection direction. A gap is formed between the cover rib 23 and the guide rail 22.

The protrusion member 13 is arranged between the guide rail 22 and the cover rib 23. The protrusion member 13 is supported by the support holder 20 to be able to reciprocate between a protrusion position P1 and a retraction position P2. Hereinafter, the direction in which the protrusion member 13 is moved is simply referred to as the "movement direction".

The protrusion position P1 is a position (position indicated by alternate long and two short dashes lines in FIGS. 3 and 6) in which the protrusion member 13 protrudes from the support holder 20 in the movement direction. The retraction position P2 is a position (position indicated by solid lines in FIG. 3 and double-dotted lines and solid lines in FIG. 5) in which the protrusion member 13 retracts into the support holder 20 in the movement direction. For the movement direction, a direction in which the protrusion member 13 is moved toward the protrusion position P1 is referred to as the "protrusion direction", and a direction in which the protrusion member 13 is moved toward the retraction position P2 is referred to as the "retraction direction".

As shown in FIG. 5, the locating protrusion portion 24 is connected to the lower end portion of the guide rail 22 (downstream side end portion in the retraction direction). The locating protrusion portion 24 protrudes from the guide rail 22 so as to be orthogonal to the guide rail 22. The locating protrusion portion 24 is opposite the protrusion member 13 in the movement direction.

When the protrusion member 13 is moved in the retraction direction to reach the retraction position P2, the protrusion member 13 abuts against the locating protrusion portion 24. In this state, the movement of the protrusion member 13 in the retraction direction is restricted by the locating protrusion portion 24, and thus the protrusion member 13 is located in the reference position P2' of the retraction position P2 which is most distant from the protrusion position P1. When the protrusion member 13 is in the reference position P2', the tip end of the protrusion member 13 (downstream side end portion in the protrusion direction) is located more inward (the upstream side in the protrusion direction) than the tip end of the support holder 20.

The movement mechanism 26 moves the protrusion member 13 between the protrusion position P1 and the retraction position P2. As shown in FIGS. 4 to 6, the movement mechanism 26 includes the support holders 20 described above, the rotation shaft 32, fixing members 45, pinion gears 27, rack gears 31 and a drive device 131.

The rotation shaft 32 extends parallel to the drive roller shaft 731*a*. The rotation shaft 32 is inserted through the collar support holes 25 of the support holders 20. The rotation shaft 32 is opposite the protrusion members 13 in a radial direction. The pinion gears 27 are fitted around the rotation shaft 32.

Figure 7:
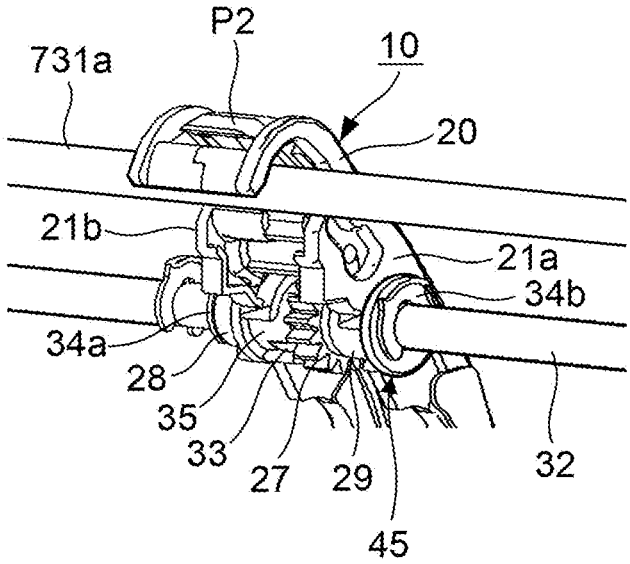
FIG. 7 is an enlarged perspective view showing a structure around the protrusion member.
Figure 8:
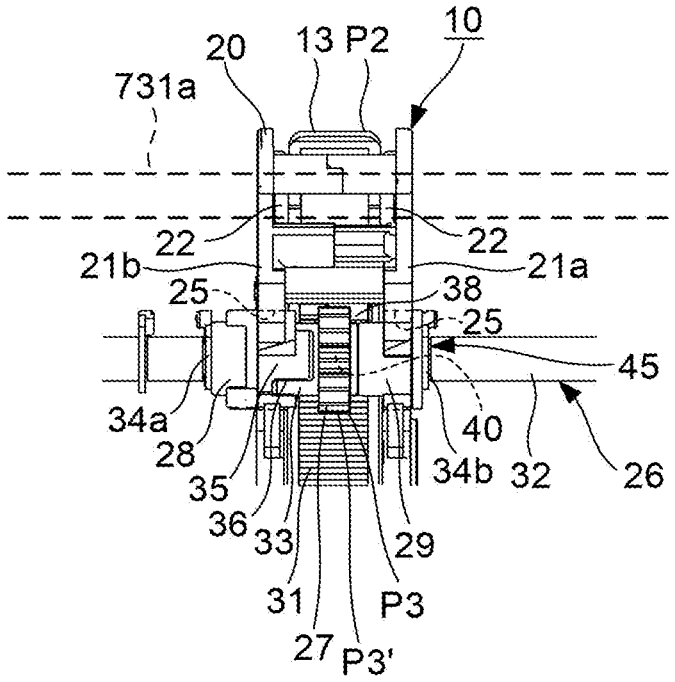
FIG. 8 is an enlarged plan view showing the structure around the protrusion member in a state where a pinion gear is located in a drive position.
Figure 9:
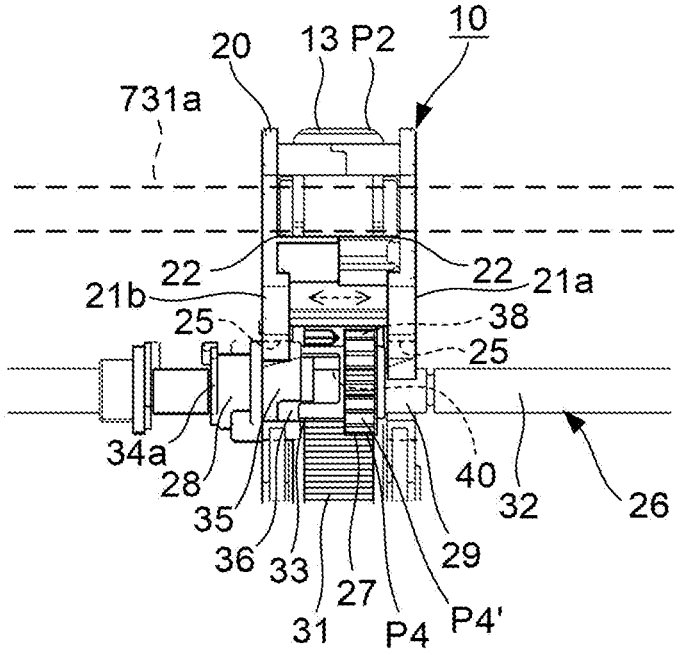
FIG. 9 is an enlarged perspective view showing a structure around a tip end portion of the protrusion member.

FIG. 7 is an enlarged perspective view showing a structure around the protrusion member 13. FIG. 8 is an enlarged plan view showing the structure around the protrusion member 13 in a state where the pinion gear 27 is located in a drive position P3. FIG. 9 is an enlarged perspective view showing a structure around a tip end portion of the protrusion member 13.

As shown in FIGS. 7 and 8, the pinion gear 27 is a spur gear which has a plurality of gear teeth on an outer circumferential surface. The rotation shaft 32 penetrates the center of the pinion gear 27 in the radial direction. The pinion gears 27 are respectively arranged in such positions as to overlap the protrusion members 13 along the longitudinal direction of the rotation shaft 32 (see FIG. 4). The pinion gear 27 is located between a pair of side wall portions 21*a* and 21*b* of the support holder 20 in the axial direction. The pinion gear 27 is opposite the protrusion member 13 in the radial direction.

The rotation shaft 32 is inserted through a through hole (not shown) formed in the center of the pinion gear 27 in the radial direction via a slight gap. In other words, the pinion gear 27 is supported to be able to reciprocate (slidable) in the axial direction with respect to the rotation shaft 32. The pinion gear 27 includes a gear side coupling portion 33 which protrudes in the axial direction.

The fixing member 45 holds the pinion gear 27 in the axial direction. The fixing member 45 includes the first set collar 28 (coupling member) and a second set collar 29 (locating member).

On one side (side of the side wall portion 21*b*) of the pinion gear 27 in the axial direction, the first set collar 28 is arranged. The first set collar 28 is inserted into the collar support hole 25 of the side wall portion 21*b* via a slight gas. The first set collar 28 is not prevented from being rotated with respect to the support holder 20. A through hole (not shown) is formed in the center of the first set collar 28 in the radial direction, and the rotation shaft 32 is inserted through the through hole. The first set collar 28 is prevented from being rotated with respect to the rotation shaft 32. When the rotation shaft 32 is rotated, the first set collar 28 is rotated together with the rotation shaft 32, and slides with respect to the collar support hole 25.

On one side (side opposite to the side wall portion 21*b*, the left side of FIG. 8) of the first set collar 28 in the axial direction, a retaining ring 34*a* is arranged. The retaining ring 34*a* is an E-ring made of metal. The retaining ring 34*a* is detachably fitted to the rotation shaft 32. The retaining ring 34*a* abuts against the first set collar 28 in the axial direction. The first set collar 28 is located between the side wall portion 21*b* and the retaining ring 34*a* in the axial direction, and abuts against the side wall portion 21*b* and the retaining ring 34*a*, with the result that the movement thereof in the axial direction is restricted.

The first set collar 28 includes a collar side coupling portion 35 which protrudes from the first set collar 28 toward the other side (the side of the side wall portion 21*b*, the right side of FIG. 8) in the axial direction. In the collar side coupling portion 35, an engagement recess portion 36 is formed which is recessed inward in the radial direction of the rotation shaft 32 (see FIG. 6).

The engagement recess portion 36 is formed such that the gear side coupling portion 33 can be inserted into the engagement recess portion 36. In a state where the gear side coupling portion 33 is inserted into the engagement recess portion 36, the engagement recess portion 36 and the gear side coupling portion 33 are opposite each other in the circumferential direction of the rotation shaft 32. When in this state, the first set collar 28 is rotated, the engagement recess portion 36 abuts against the gear side coupling portion 33, and thus the pinion gear 27 is rotated together with the first set collar 28.

On the other side (side opposite to the first set collar 28 through the pinion gear 27, the right side of FIG. 8) of the pinion gear 27 in the axial direction, the second set collar 29 is arranged. The second set collar 29 is inserted into the collar support hole 25 of the side wall portion 21*a*. A through hole (not shown) is formed in the center of the second set collar 29 in the radial direction, and the rotation shaft 32 is inserted through the through hole via a slight gas. The second set collar 29 is prevented from being rotated with respect to the collar support hole 25. When the rotation shaft 32 is rotated, the outer circumferential surface of the rotation shaft 32 slides with respect to the inner circumferential surface of the second set collar 29.

As shown in FIG. 8, on the other side (side opposite to the first set collar 28, the right side of FIG. 8) of the second set collar 29 in the axial direction, a retaining ring 34*b* is arranged. The retaining ring 34*b* is an E-ring made of metal. The retaining ring 34*b* is detachably fitted to the rotation shaft 32. In a state where the retaining ring 34*b* is fitted to the rotation shaft 32, the other side of the second set collar 29 abuts against the retaining ring 34*b* in the axial direction, with the result that the movement thereof to the other side in the axial direction is restricted.

In this state, the pinion gear 27 and the second set collar 29 are opposite each other in the axial direction. In this state, the pinion gear 27 abuts against the second set collar 29, and thus the movement to the other side (side opposite to the first set collar 28, the right side of FIG. 8) in the axial direction is restricted.

FIG. 9 is a plan view showing a state where the retaining ring 34*b* is removed in the state shown in FIG. 8, and the pinion gear 27 is moved to a separation position P4. As shown in FIG. 9, in the state where the retaining ring 34*b* is removed from the rotation shaft 32, the second set collar 29 can be removed along the rotation shaft 32 to the outside of the collar support hole 25.

Figure 10:
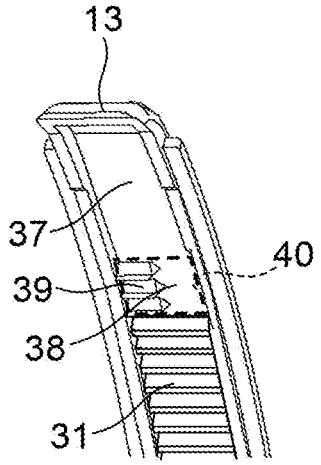
FIG. 10 is an enlarged perspective view showing a structure around a tip end of a rack gear.

FIG. 10 is an enlarged perspective view showing a structure around a tip end of the rack gear 31. As shown in FIGS. 8 to 10, the rack gear 31 is a rack gear which includes a plurality of gear teeth aligned along the movement direction of the protrusion member 13. The rack gear 31 is formed on a surface 37 of the protrusion member 13 opposite the pinion gear 27.

The rack gear 31 can be engaged with the pinion gear 27. In a state where the pinion gear 27 and the rack gear 31 are engaged with each other, the pinion gear 27 and the rack gear 31 form a rack and pinion gear mechanism in which the pinion gear 27 serves as a pinion gear. In other words, when the pinion gear 27 is rotated in the state where the pinion gear 27 and the rack gear 31 are engaged with each other, the rack gear 31 is moved along the rotation direction of the pinion gear 27. In this way, the protrusion member 13 is moved.

In a downstream side end portion of the rack gear 31 in the protrusion direction, a narrow width region 40 is formed. The narrow width region 40 includes a cutout portion 38 and a narrow width gear 39. The cutout portion 38 is formed by cutting out the rack gear 31 from the other side (side of the second set collar 29, the right side of FIGS. 8 and 9) to one side (side of the first set collar 28, the left side of FIGS. 8 and 9) in the axial direction.

The narrow width gear 39 is the remaining part of the rack gear 31 which is cut out for the cutout portion 38. The narrow width gear 39 is adjacent to one side of the cutout portion 38 in the axial direction. The pinion gear 27 is engaged with the rack gear 31 in the narrow width gear 39 and is separated from the rack gear 31 in the cutout portion 38.

With reference back to FIG. 8, in a state where the retaining ring 34*a* is fitted to restrict the movement of the second set collar 29 in the axial direction, the pinion gear 27 is located in the drive position P3. The drive position P3 is the position (the position of the pinion gear 27 in FIG. 8) of the pinion gear 27 in the axial direction in which the pinion gear 27 and the rack gear 31 are engaged with each other. When in a state where the pinion gear 27 is in the drive position P3, the pinion gear 27 is located in such a position as to overlap the cutout portion 38 in the movement direction, the pinion gear 27 is engaged with the narrow width gear 39.

When as shown in FIG. 9, the retaining ring 34*a* is removed, and thus the movement restriction of the second set collar 29 and the pinion gear 27 is released, the pinion gear 27 can reciprocate between the drive position P3 and the separation position P4 in the axial direction. The separation position P4 is the position (the position of the pinion gear 27 in FIG. 9) of the pinion gear 27 which is located on the other side of the drive position P3 in the axial direction.

A position in which the pinion gear 27 overlaps the narrow width region 40 in the movement direction and overlaps the narrow width gear 39 in the axial direction is assumed to be a meshing position P3'. In a state where the pinion gear 27 is located in the meshing position P3', the pinion gear 27 is engaged with the rack gear 31 via the narrow width gear 39.

A position in which the pinion gear 27 is in the separation position P4 in the axial direction and overlaps the narrow width region 40 in the movement direction is assumed to be a release position P4'. When the pinion gear 27 is in the release position P4', the engagement of the pinion gear 27 and the narrow width gear 39, that is, the rack gear 31 is released. When the pinion gear 27 is located in the separation position P4 and is located on the side of the retraction direction with respect to the narrow width region 40 in the movement direction, the pinion gear 27 is engaged with the rack gear 31.

Even when the pinion gear 27 is located either in the drive position P3 or the separation position P4, the gear side coupling portion 33 is inserted into the engagement recess portion 36, and thus the pinion gear 27 is prevented from being rotated with respect to the first set collar 28.

With reference back to FIG. 4, the drive device 131 includes a drive motor 807, a drive transmission pulley 806 and a drive transmission belt 805. The drive motor 807 includes a main body 808, a motor shaft 809 which protrudes from the main body 808 and a motor gear 810 which is fixed to an end portion of the motor shaft 809, and outputs a rotational driving force via the motor shaft 809 and the motor gear 810. The rotation control (such as a rotation angle and the number of revolutions) of the drive motor 807 is performed by the post-processing control unit 100.

The drive transmission pulley 806 is a toothed pulley which is fixed to the rotation shaft 32, and is rotated together with the rotation shaft 32. The drive transmission belt 805 is an endless toothed belt which is wound around the motor gear 810 and the drive transmission pulley 806.

When the rotational driving force is output to the drive motor 807, the motor gear 810 is rotated, the rotational driving force is transmitted to the rotation shaft 32 via the drive transmission belt 805 and the drive transmission pulley 806 and thus the rotation shaft 32 is rotated. When the rotation shaft 32 is rotated, as described above, the two protrusion members 13 are simultaneously moved by the movement mechanism 26 between the protrusion position P1 and the retraction position P2.

When the configuration of the embodiment is adopted, in a state where the pinion gear 27 is in the release position P4', the pinion gear 27 and the rack gears 31 are separated from each other, and thus the engagement thereof can be released. Even when in this state, one of the protrusion members 13 is displaced in the movement direction, since the pinion gear 27 is separated from the rack gear 31, the rotation shaft 32 is not rotated, and the other protrusion member 13 is also not moved. Hence, in this state, the position of the protrusion member 13 in the movement direction, that is, the amount of protrusion can be adjusted.

Specifically, when the protrusion member 13 is moved until the pinion gear 27 overlaps the cutout portion 38 in the movement direction, and thereafter the pinion gear 27 is moved to the separation position P4 (release position P4'), the pinion gear 27 is opposite the cutout portion 38 to be separated from the rack gear 31. Consequently, each of the protrusion members 13 can be moved in the direction (the direction of the retraction position P2) in which the rack gear 31 is not formed. Then, the amount of protrusion of each of the protrusion members 13 is adjusted, and thereafter the pinion gear 27 is moved to the drive position P3 again, with the result that it is possible to accurately equalize the amounts of protrusion of the protrusion members 13. The pinion gear 27 can be moved to the drive position P3 and the release position P4' without the movement mechanism 26 being disassembled, and thus it is possible to suppress the complication of the adjustment of the amount of protrusion. Hence, with the simple configuration, it is possible to provide the sheet ejection device 10 in which the amount of protrusion of the protrusion member 13 can easily be adjusted.

As described above, the retaining ring 34*b* is removed, and thus the second set collar 29 and the pinion gear 27 can be moved between the drive position P3 and the separation position P4, with the result that it is possible to switch between the location of the pinion gear 27 and the release of the location with the simple configuration.

A user can also manually perform the removal of the retaining ring 34*b* and the second set collar 29, the movement of the pinion gear 27 between the drive position P3 and the separation position P4 and the adjustment of the amount of protrusion of the protrusion member 13 described above. Hence, even in a state where the power of the sheet post-processing device is turned off, the amount of protrusion of each of the protrusion members 13 can be adjusted.

As described above, the cutout portion 38 is formed in the downstream side end portion of the rack gear 31 in the protrusion direction. Hence, in a state where the protrusion member 13 is located in the retraction position P2, the pinion gear 27 and the cutout portion 38 overlap each other in the movement direction. In this way, each of the protrusion members 13 is made to abut against the locating protrusion portion 24, and thus it is possible to reliably locate the protrusion member 13 in the retraction position P2. Hence, it is easy to adjust the amount of protrusion of each of the protrusion members 13.

The present disclosure is not limited to the embodiment described above, and various variations can be made without departing from the spirit of the present disclosure. For example, although in the embodiment described above, the image forming apparatus 200 of the image forming system S is the multifunctional peripheral for monochrome printing, the present disclosure is not limited to this configuration. The image forming apparatus 200 may be, for example, a monochrome copying machine, a monochrome printer or the like or an image forming apparatus for color printing such as a color copying machine or a color printer.

Figure 11:
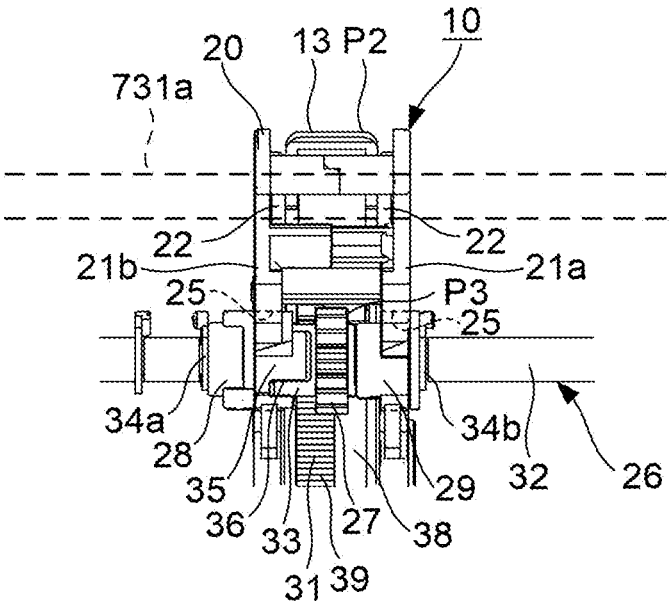
FIG. 11 is a plan view showing a variation of the sheet ejection device according to the embodiment.

As shown in FIG. 11, a configuration can be adopted in which the narrow width region 40 is formed in the entire area of the rack gear 31 in the movement direction. In other words, the cutout portion 38 is formed in the entire area of the rack gear 31 in the movement direction. In this case, in a state where the pinion gear 27 is located in the drive position P3, the rack gear 31 is engaged with one half or more of the pinion gear 27 in the axial direction. In this way, regardless of the position of the protrusion member 13 in the movement direction, the protrusion member 13 is moved to the other side (side opposite to the first set collar 28) in the axial direction, and thus the pinion gear 27 overlaps the cutout portion 38. Hence, it is possible to easily separate the pinion gear 27 and the rack gear 31.

The post-processing control unit 100 can perform a locating mode. When the locating mode is performed, the motor gear 810 is rotated by a predetermined rotation angle, and then when the cutout portion 38 overlaps the pinion gear 27 in the movement direction, the rotation is stopped. The locating mode can be performed by an input from an input unit (not shown) such as a touch panel provided in the main body control unit 213. The input may be made from a higher level device (such as a personal computer) connected to the image forming system S.

In this way, the user can visually check, in this state, the displacement of the position of each of the protrusion members 13 in the movement direction. Furthermore, the user can release the engagement of the pinion gear 27 and the rack gear 31 in a state where the locating mode has been performed.

What is claimed is:

1. A sheet ejection device comprising:

an ejection roller pair which ejects a sheet from an ejection port in a predetermined ejection direction;

a stacking tray which is arranged on a downstream side of the ejection roller pair in the ejection direction and on which the sheet ejected by the ejection roller pair is stacked;

a protrusion member which protrudes above the stacking tray from the ejection port and is supported to be able to reciprocate between a protrusion position where a tip end of the sheet ejected by the ejection roller pair is brought into contact with an upper surface to be guided in the ejection direction and a retraction position where the protrusion member is retracted from above the stacking tray; and a movement mechanism which moves the protrusion member in a predetermined movement direction between the protrusion position and the retraction position, wherein the movement mechanism includes:

a rotation shaft which extends in a width direction orthogonal to the ejection direction and is rotatably supported;

a holding member which is coupled to the rotation shaft and holds the protrusion member movably along the movement direction; and a rack and pinion mechanism which includes:

a pinion gear supported by the rotation shaft; and a rack gear including a large number of gear teeth which are formed on a surface of the protrusion member opposite the pinion gear and are aligned along the movement direction of the protrusion member, in at least a part of the rack gear in the movement direction, a narrow width region is provided which is formed by cutting out a part of the gear teeth in the axial direction and which includes a narrow width gear and a cutout portion, in the narrow width region, the pinion gear is slidable between a meshing position where the pinion gear meshes with the narrow width gear and a release position where the pinion gear is opposite the cutout portion such that the meshing with the narrow width gear is released and in a state where the pinion gear has slid to the release position, the protrusion member can be relatively moved with respect to the pinion gear in the movement direction.

2. The sheet ejection device according to claim 1, wherein the holding member includes:

a locating member which locates the pinion gear in the meshing position; and a coupling member which is engaged with the rotation shaft and the pinion gear to restrict rotation of the pinion gear with respect to the rotation shaft.

3. The sheet ejection device according to claim 1, wherein the narrow width region is formed in a position in which in a state where the protrusion member is in the retraction position, the protrusion member is opposite the pinion gear in the movement direction.

4. The sheet ejection device according to claim 3, wherein the holding member includes a locating protrusion portion which abuts against the protrusion member to locate the protrusion member in a reference position of the retraction position that is most distant from the protrusion position in the movement direction.

5. The sheet ejection device according to claim 1, wherein the narrow width region is formed in an entire area of the rack gear in the movement direction.

6. A sheet post-processing device comprising:

a post-processing mechanism which performs predetermined post-processing on the sheet; and the sheet ejection device according to claim 1 that is arranged on a downstream side of the post-processing mechanism in the ejection direction and uses the ejection roller pair to stack, on the stacking tray, the sheet on which the post-processing has been performed by the post-processing mechanism.

7. An image forming system comprising:

an image forming apparatus which forms an image on the sheet; and the sheet post-processing device according to claim 6 which is coupled to the image forming apparatus and performs the post-processing on the sheet.

* * * * *